US007286124B2

(12) United States Patent
Van Der Broeck et al.

(10) Patent No.: US 7,286,124 B2
(45) Date of Patent: Oct. 23, 2007

(54) CIRCUIT ARRANGEMENT FOR THE AC POWER SUPPLY OF A PLASMA DISPLAY PANEL

(75) Inventors: Heinz Van Der Broeck, Zülpich (DE); Matthias Wendt, Würselen (DE)

(73) Assignee: Koninklijke Philips Electronics N.V., Eindhoven (NL)

( * ) Notice: Subject to any disclaimer, the term of this patent is extended or adjusted under 35 U.S.C. 154(b) by 217 days.

(21) Appl. No.: 10/500,762

(22) PCT Filed: Dec. 18, 2002

(86) PCT No.: PCT/IB02/05574

§ 371 (c)(1),
(2), (4) Date: Jul. 6, 2004

(87) PCT Pub. No.: WO03/058590

PCT Pub. Date: Jul. 17, 2003

(65) Prior Publication Data

US 2005/0116763 A1 Jun. 2, 2005

(30) Foreign Application Priority Data

Jan. 11, 2002 (DE) ..... 102 00 828

(51) Int. Cl.
*G09G 5/00* (2006.01)

(52) U.S. Cl. ..... 345/211; 345/212; 345/60; 345/63; 345/52; 345/66; 713/300; 348/730

(58) Field of Classification Search ..... 345/211, 345/212, 41, 42, 60–69
See application file for complete search history.

(56) References Cited

U.S. PATENT DOCUMENTS

| | | | | |
|---|---|---|---|---|
| 5,844,373 | A * | 12/1998 | Yao et al. | 315/205 |
| 6,011,355 | A | 1/2000 | Nagai | |
| 6,657,604 | B2 * | 12/2003 | Huang et al. | 345/60 |
| 2001/0023488 | A1 * | 9/2001 | Breunig et al. | 713/300 |

* cited by examiner

*Primary Examiner*—Richard Hjerpe
*Assistant Examiner*—Jennifer T Nguyen

(57) ABSTRACT

A circuit arrangement for commutating the AC voltage of a plasma display panel, in which the losses and electromagnetic interference which occur as a result of the influence of parasitic resistances (coils, supply lines, semiconductor switches) and the attendant hard charging and discharging processes, are substantially avoided. For the charging operation of the capacitor (Cp) of the plasma cells the oscillation circuit is supplied with an auxiliary charging voltage (u1) whose value exceeds 50% of the input voltage (U0). The oscillation circuit for the discharging operation is supplied with an auxiliary discharging voltage (u2) whose value falls short of 50% of the input voltage (U0). The two auxiliary voltages are connected to a DC converter.

Figure 1:
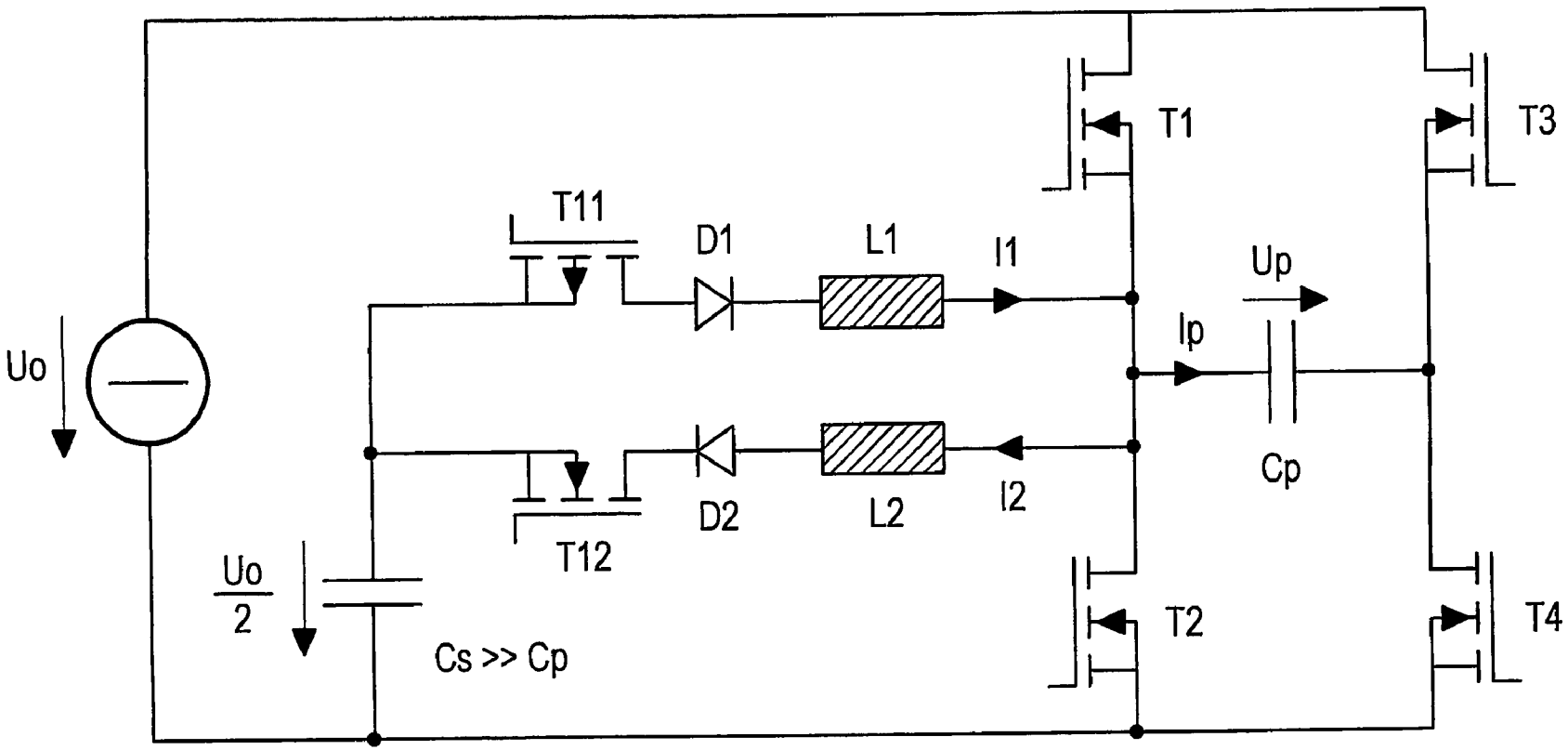

29 Claims, 4 Drawing Sheets state of the art state of the art

CIRCUIT ARRANGEMENT FOR THE AC POWER SUPPLY OF A PLASMA DISPLAY PANEL

The invention relates to a circuit arrangement for an AC voltage supply of a plasma display panel (PDP), more particularly a sustain driver. PDPs are flat picture screens or televisions which are produced with the aid of plasma technology. Light is then generated by small gas discharges between two glass plates. In principle, small, individual plasma discharge lamps are driven via electrodes arranged horizontally and vertically. Considerable electronic circuitry is necessary for operating the plasma cells. The so-called sustain driver whose task is to supply trapezoidal AC voltages to the self-capacitances of the plasma cells takes up the largest surface area. The electrodes of the plasma cells are then connected to the outputs of two half bridges of a commutation circuit. The two outputs of the half bridges may apply the positive input voltage +U0, the negative input voltage −U0 or the zero voltage (short-circuit of the electrode terminals) to the electrodes of the plasma cells. The two half bridges operate on an auxiliary voltage which corresponds to 50% of the input voltage U0. For the cells to be ignited, a rapid change from the positive to the negative voltage and vice versa is to take place on the electrodes. For this purpose, the voltage output of a half bridge converter is alternately connected to the positive voltage pole, whereas the other voltage output is applied to the minus pole. In so far as the two transitions are directly consecutive, the voltage on the plasma cells changes very rapidly from a negative to a positive value of the input voltage U0. As a result, the cells are ignited. To avoid losses which arise during the direct charging and discharging of the capacitor of the plasma cell, the sustain driver is usually structured as a resonant switched-mode power supply in which the charging and discharging of the capacitor of the plasma cell takes place free of losses in principle. When this principle of resonance is realized and converted, the oscillation is attenuated because the coils, supply lines and semiconductor switches represent parasitic resistances. This leads to the fact that the voltage on the plasma cell does not completely jump to the input voltage or zero, respectively. In consequence, the bridge transistors are included in the circuit leading to the development of a loss-affected recharging or residual discharge. The currents linked with this are flowing with each recharging even when the plasma cells should not light up. The loss-affected recharging or residual discharge further causes problems with respect to the electromagnetic compatibility (EMV). The influence of the parasitic resistances is noticeable as a characteristic stage in the oscillation curve of the plasma voltage. Once the charging current for the capacitor of the plasma cell has reached its output value, thus substantially zero, the characteristic stage appears in the oscillation curve.

From U.S. Pat. No. 6,011,355 is known a circuit for driving a plasma display panel which mitigates the characteristic stage of the oscillation curve for the plasma voltage, but this plasma voltage, however, is still present. In the respective circuit the oscillation potential is formed by a single capacitor.

Therefore, it is an object of the invention to provide a circuit arrangement for the supply of an AC voltage to a plasma display panel in which the losses occurring as a result of the parasitic resistances and electromagnetic disturbances are substantially avoided.

The object is achieved according to the invention in that for the charging operation the auxiliary voltage present in the symmetrical commutation circuit is selected higher than in the state of the art, in which it is 50% of the input voltage U0. The increase is then, based on calculation, experience or attempts, selected such that the oscillation attenuated by the parasitic resistances reaches the desired final value U0. When the respective bridge transistor is subsequently switched through, no disturbing recharging current occurs any longer. In order to avoid a residual charge when the capacitor of the plasma cell is discharged, in the solution according to the invention the auxiliary voltage is reduced. The value of the reduction is then arranged so that the attenuated oscillation reaches a final zero value. Consequently, a complete discharging of the capacitor of the plasma cell from U0 to zero is ensured, so that a disturbing residual charge is canceled when the other bridge transistor is connected. In the solution according to the invention there is no longer a single auxiliary voltage UH which corresponds to 50% of the input voltage U0, but for the charging operation there is an auxiliary voltage that exceeds 50% of the input voltage U0 and an auxiliary discharging voltage that falls short of 50% of the input voltage U0.

In an embodiment of the circuit arrangement according to the invention the auxiliary charging voltage and the auxiliary discharging voltage are decoupled from each other by simple DC converters.

Figure 2:
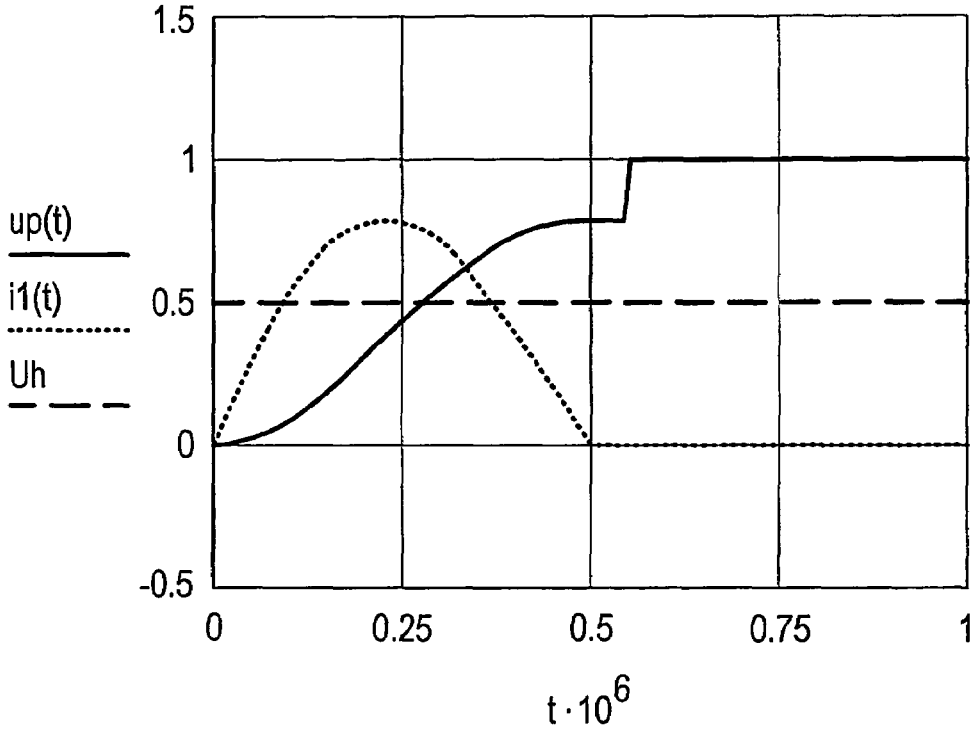

In practice a plurality of sustain drivers for PDPs are arranged in parallel. The DC/DC converters necessary for the generation and regulation of the auxiliary charging voltage and auxiliary discharging voltage are then necessary only once. The regulation of the two auxiliary voltages is then effected irrespective of the operation of the PDP drive. An advantage of this circuit arrangement according to the invention is that only average powers are transmitted. A further advantage of the invention is that a very simple circuit can be constructed that requires little space and is cost-effective. With the aid of this active division into two divided auxiliary voltages, according to the object of the invention the losses and disturbances of the electromagnetic compatibility are considerably reduced. In the following is described an embodiment of the invention in which the state of the art shows:

in FIG. 1 the transistor bridge for generating the cell voltage with a conventional commutation circuit (for clarity only the commutation circuit of a half bridge is shown);

in FIG. 2 the influence of the parasitic resistances on the cell voltage Up of the capacitor Cp of the plasma cell.

Figure 3:
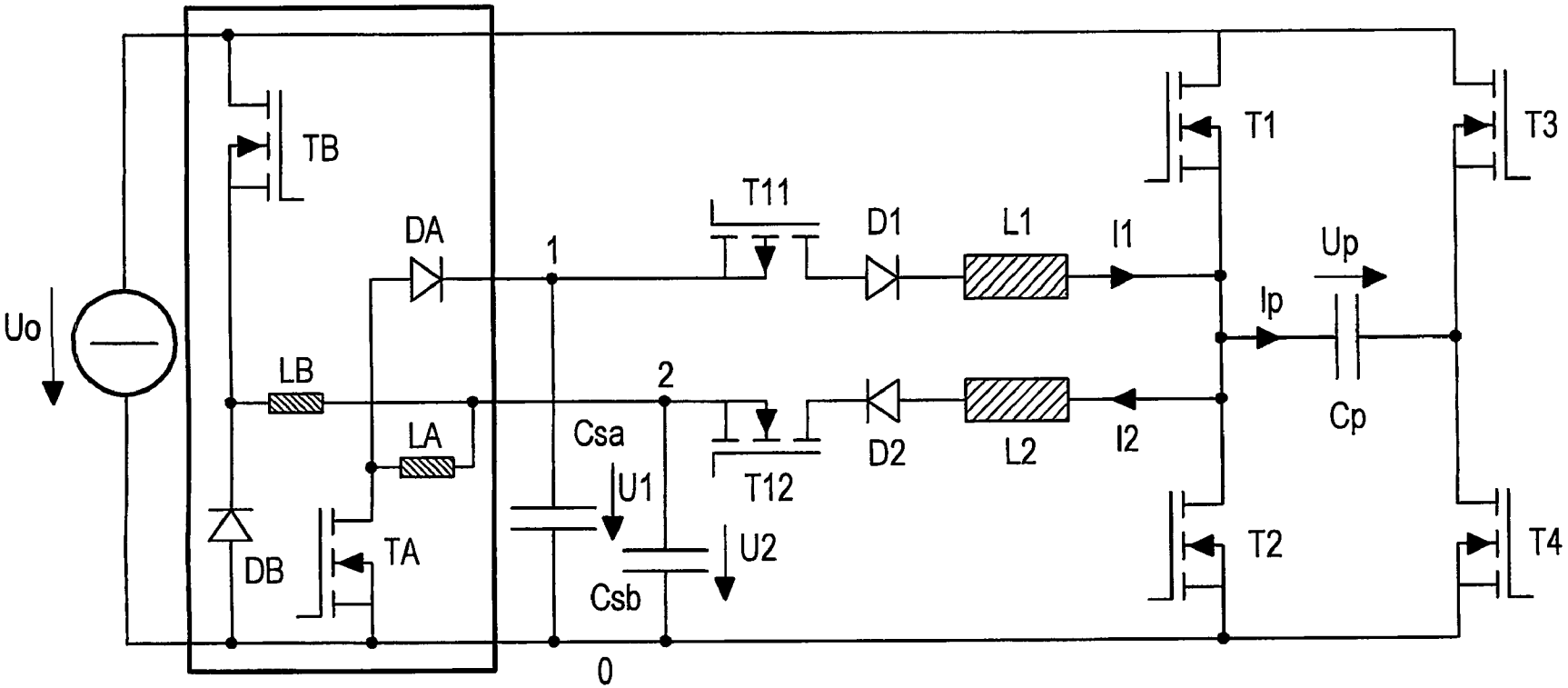
Figure 4:
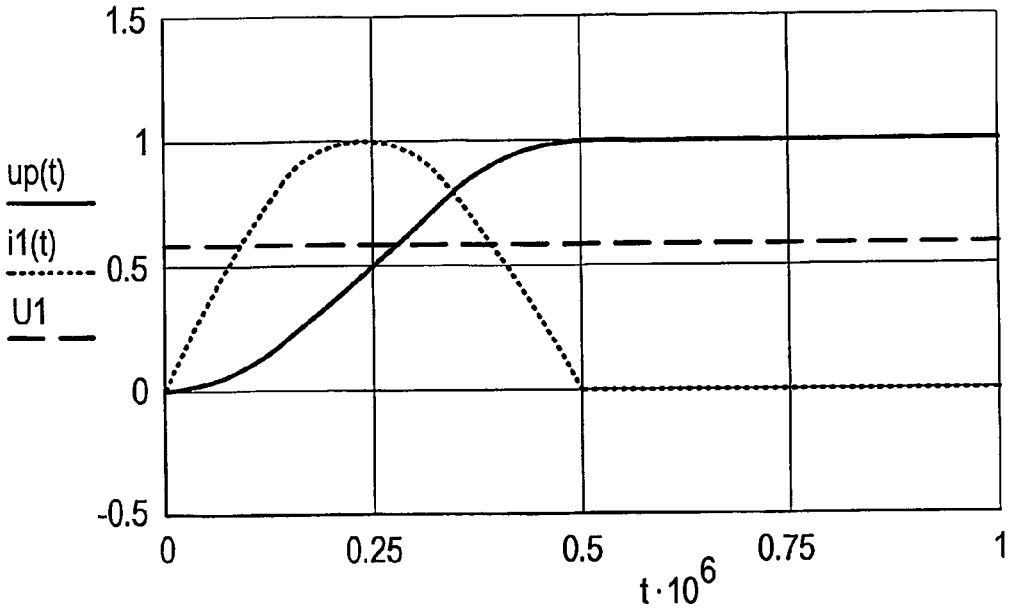
Figure 5:
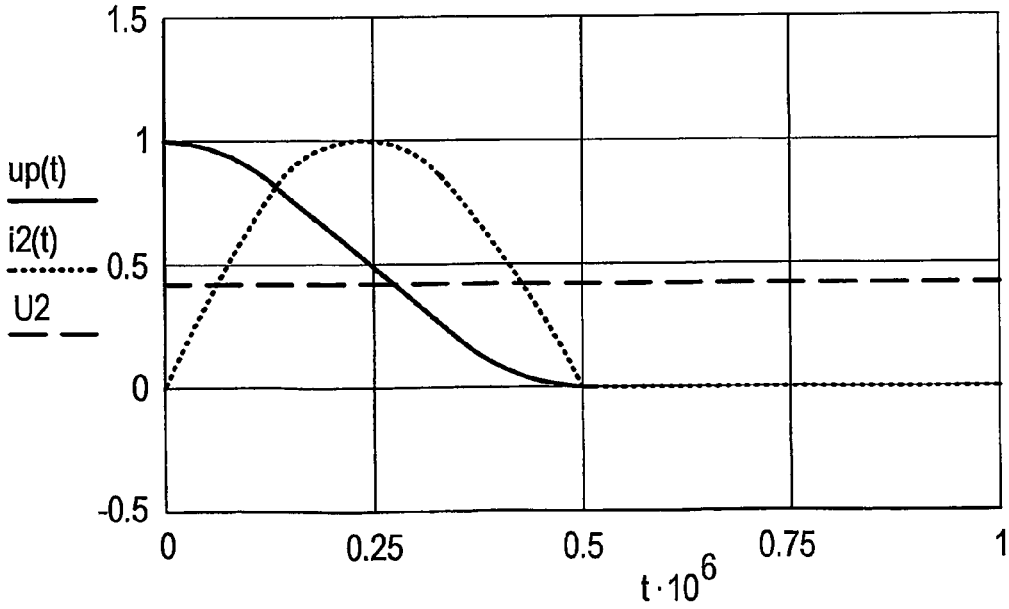

The invention further shows in:

FIG. 3 the transistor bridge for generating a cell voltage with a commutation circuit via a separate auxiliary charging or auxiliary discharging voltage (for clarity only the commutation circuit of a half bridge is shown);

FIG. 4 a diagram showing a charging operation of the capacitor Cp of the plasma cell with a compensation of the influence of the parasitic resistances;

FIG. 5 shows a diagram of a discharging operation of the capacitor Cp of the plasma cell with a compensation of the influence of the parasitic resistances.

The transistor bridge shown in FIG. 1 with a conventional commutation circuit in essence comprises two half bridges. The electrodes of the plasma cells are connected to its outputs. Depending on the drive of the transistors T1, T2, T3 and T4 the positive input voltage Up=+U0, the negative input voltage Up=U0, or the zero voltage Up=0 (short-circuit of the electrode terminals) is present on the outputs of the two half bridges. For the plasma cells to ignite, there must be a rapid change from the positive to the negative voltage and vice versa. For this purpose, the voltage output of a half bridge converter is alternately applied to the positive voltage pole, while the respective other voltage output is applied to the negative voltage pole. In so far as the two transitions directly follow each other, the voltage on the plasma cells very rapidly changes from the negative to the positive value of the input voltage U0. This causes the plasma cells to be ignited in so far as additionally an addressing is made. The ignition current for light generation then flows via the diagonal transistors T1 and T4 or T2 and T3 of the bridge circuit. Each half bridge comprises an oscillation circuit with FIGS. 1 and 3 only showing one half bridge. The single oscillation circuit comprises a capacitor Cp of the plasma cell and the inductance L1 for the charging operation and L2 for the discharging operation. The charging operation is initiated by means of an auxiliary transistor T11 which is connected in series to the inductance L1 and the discharging operation is initiated by the auxiliary transistor T12 which is connected in series to the inductance L2. The diodes D1 and D2 arranged between the auxiliary transistors T11, T12 and the inductances provide that each time only one charging or discharging current occurs in a semi-oscillation. In a symmetrical arrangement and drive of the commutation circuit the half input voltage U0 appears on the capacitor Cs substantially as an auxiliary voltage Uh, which means Uh=U0/2. A capacitor Cs is then selected so large that there is no change of the capacitor voltage on the capacitor Cs, i.e. Cs>>Cp within one switching period. If now the empty capacitor Cp of the plasma cells is connected to the capacitor Cs charged with the auxiliary voltage Uh via the auxiliary transistor T11 used as a switch, an oscillation operation will arise which is limited to a sine oscillation of the charging current I1. The termination after a half period is effected by the diode D1 in the circuit that allows only the positive wave. At the same time, together with the sine oscillation of the charging current I1, a cosine-shaped cell voltage Up builds up on the capacitor Cp of the plasma cell, which cell voltage Up rises from zero to approximately double the value of the auxiliary voltage Uh on the capacitor Cs, which approximately corresponds to the input voltage U0. As a result of the parasitic resistances determined by the coils, supply lines and semiconductor circuit, the voltage Up, however, is attenuated and does not reach the value of the input voltage U0 during the charging operation.

The discharging of the capacitor Cp of the plasma cell with the aid of the oscillation circuit comprising the capacitor Cp and the inductance L2 is effected only substantially free of losses because of the parasitic resistances. In this case the oscillation operation is initiated when the auxiliary transistor T12 is turned on.

After the oscillation operation has ended, either the upper or the lower transistor of the half bridge (T1, T2) is connected. Since the cell voltage Up on the capacitor Cp of the plasma cell has not reached the value of the input voltage U0 as a result of the attenuated oscillation, the recharging current Ip will flow when the half bridge T1 is connected. The jump from Up to U0 of the maximum voltage that can be reached during the charging operation at the switch-on time T1 is shown in FIG. 2. The normalized representation of the influence of the parasitic resistances during the charging operation in FIG. 2 is related to the input voltage U0 as regards the cell voltage Up and as regards the charging current I1 to the input voltage U0 divided by the impedance Z0, where Z0 is formed by $$Z0 = \sqrt{\frac{L0}{Cp}}$$

The recharging shown in FIG. 2 as a jump in the voltage curve is a residual discharge during the discharging operation. The cell voltage Up then reaches the zero value only substantially. The jump to zero takes place when the transistor T2 is connected. The inherent currents are flowing with each oscillation even when the plasma cells should not light up. The recharging or residual discharging causes additional losses and problems with the electromagnetic compatibility (EMV).

The circuit arrangement according to the invention shown in FIG. 3 distinguishes itself from the conventional circuit arrangements by an additional DC/DC converter and a separate auxiliary voltage U1 for the charging operation and a separate auxiliary voltage U2 for the discharging operation. The two auxiliary voltages U1 and U2 are applied to the auxiliary capacitor having capacitance Csa and the auxiliary capacitor having capacitance Csb. The capacitances of the auxiliary capacitor are clearly larger than the capacitance of the plasma cells, so that the voltage applied to these auxiliary capacitors is substantially constant within the repetition frequency of the generated AC voltage. In the embodiment shown the DC/DC converter comprises a boost converter for the charging operation and a buck converter for the discharging operation.

The boost converter is constituted by a diode DA, an inductor LA and a transistor T1, the transistor TA having its source connected to ground and having with its drain a connection point of the inductor LA and the anode of the diode DA. The diode DA is connected with its other end to the transistor T11 and the inductor LA with its other end to the transistor T12.

The buck converter is constituted by a diode DB, an inductor LB and a transistor TB, the source of the transistor TB, the cathode of the diode DB and the one end of the inductor LB forming a common connection point. The anode of the diode DB is connected to ground, the other end of the inductor LB to the auxiliary transistor T12 and the drain of the transistor TB to the positive input voltage U0.

The auxiliary charging capacitor having capacitance Csa is connected, on the one hand, to the connection point 1 to which are also connected the cathode of the diode DA and the source of the transistor T11. The other end of the auxiliary charging capacitor having capacitance Csa is connected to ground just like the one end of the auxiliary capacitor having capacitance Csb. The other end of the auxiliary discharging capacitor having capacitance Csb is connected to the connection point 2 to which a respective end of the inductor LA and the inductor LB as well as the source of the transistor T12 are connected.

The energy consumption of the auxiliary discharging capacitor having capacitance Csb in an advantageous embodiment of the invention is transported via a DC voltage converter in the auxiliary capacitor having capacitance Csa. This means that within a voltage change from Up=U0 to zero and again to Up=U0, the energy stored in the capacitor Cp of the plasma cells is first transferred to the capacitor having capacitance Csb, from there to the capacitor Csa by means of the DC voltage converter and subsequently again to the capacitor Cp. In this example of embodiment the DC voltage converter is arranged as a boost converter constituted by the elements of transistor TA, coil LA and diode DA This boost converter can transfer the commutation energy by means of continuous power flux and thus with little current. The boost converter simultaneously stabilizes the auxiliary voltage U1 at the desired value via a suitable control loop which is not further shown here.

The losses in the resonant commutation evolving on grounds of parasitic resistances are taken from the main supply voltage by means of the buck converter. The buck converter which comprises the elements of transistor TB, coil LB and diode DB, can transfer the power to compensate for losses caused by continuous power flux and thus with little current. It then stabilizes the auxiliary voltage U2 via a suitable control loop which is not shown here either.

FIG. 4 is a diagram showing the charging operation of the capacitor Cp of the plasma cell with a compensation of the influence of the parasitic resistances. The representation is normalized, the cell voltage up(t) being related to the input voltage U0 and the charging current i1(t) to the input voltage U0 divided by the impedance Z0. The impedance Z0 is then formed by:

$$Z0 = \sqrt{\frac{L0}{Cp}}$$

The auxiliary charging current u1 is also related to the input voltage U0. Since according to the invention the auxiliary charging voltage u1 exceeds the half input voltage U0, in the normalized representation it has a value that is greater than 0.5. In the example of embodiment shown it is 10% higher, thus has the value 0.55. The auxiliary charging voltage u1 is constant during the charging operation. The charging current i1(t) is attenuated by the parasitic resistances and reaches the normalized value 1 as desired. The cell voltage Up reaches the desired end value at the end of the half period of the sine-wave oscillation, which end value corresponds to the input voltage U0 and is here written as 1 in the normalized representation. If the transistor T1 is connected, there will no longer be a jumpy increase of the cell voltage Up.

FIG. 5 is a diagram showing the discharging operation of the capacitor Cp of the plasma cell with a compensation of the influence of the parasitic resistances. The representation is also normalized, the cell voltage up(t) being related to the input voltage U0 and the discharging current i2(t) to the input voltage U0 divided by the impedance Z0. The impedance Z0 is then formed as described with reference to FIG. 2. The auxiliary discharging current u2 also relates to the input voltage U0. Since, according to the invention, the auxiliary discharging voltage u2 is lower than 50% of the input voltage, it has a value that is smaller than 0.5 in the normalized representation. In the example of embodiment shown it is 45% of the input voltage U0, thus has the value 0.45. The auxiliary discharging voltage u2 is constant during the discharging operation. The discharging current i2(t) carries out a sine-wave oscillation during a half period, starting with zero, rising to the maximum 1 and again going back to 0, while the cell voltage up(t) also reaches the value 0 at this instant. Thus after the discharging operation has been terminated, no residual voltage is present any longer on the capacitor Cp of the plasma cell.

For example MOSFETs (Metal Oxide Semiconductor-Field-Effect Transistors) or IGBTs (Insulated Gate Bipolar Transistors) can be used as switches for the circuit arrangement according to the invention.

The invention claimed is:

1. A circuit arrangement for an AC voltage supply of a plasma display panel, the arrangement comprising:

a transistor bridge having a pair of voltage input nodes and a pair of voltage output nodes, an input voltage coupled to the pair of voltage input nodes of the transistor bridge, a capacitor of a plasma cell coupled to the pair of voltage output nodes of the transistor bridge, a DC voltage converter that provides an auxiliary charging voltage from the input voltage, and a charging current circuit that receives the auxiliary charging voltage and provides charging current to the capacitor.

2. The circuit arrangement of claim 1, wherein the DC voltage converter is a boost converter.

3. The circuit arrangement of claim 2, wherein the boost converter comprises a supply transistor, a supply diode and a supply inductor.

4. The circuit arrangement of claim 3, wherein the DC voltage converter provides the auxiliary charging voltage to a charging capacitor, and an auxiliary discharging voltage to a discharge capacitor, and the inductor and diode are arranged in series between the charging capacitor and discharging capacitor.

5. The circuit arrangement of claim 3, wherein the supply transistor shares a first connection point with an auxiliary charging capacitance that stores the auxiliary voltage and a ground terminal of the input voltage, and a second connection point shared with the supply inductor and an anode of the supply diode.

6. The circuit arrangement of claim 5, wherein a cathode of the supply diode has a connection point shared with a charging transistor of the charging current circuit and the auxiliary charging capacitor.

7. The circuit arrangement of claim 5, wherein the supply inductor is connected at least to a discharging transistor of a discharging current circuit.

8. The circuit arrangement of claim 3, wherein the auxiliary charging voltage is greater than half the input voltage.

9. The circuit arrangement of claim 1, wherein the auxiliary charging voltage is greater than half the input voltage.

10. The circuit arrangement of claim 1, wherein the charging current circuit includes a series combination of a charging transistor, a charging diode and a charging inductor.

11. The circuit arrangement of claim 1, wherein the auxiliary charging voltage is applied to an auxiliary capacitor.

12. The circuit arrangement of claim 11, wherein a capacitance of the auxiliary capacitor is much larger than a capacitance of the capacitor of the plasma cell.

13. The circuit arrangement of claim 1, wherein the DC voltage converter provides an auxiliary discharging voltage, and the auxiliary charging voltage is generated from the auxiliary discharging voltage.

14. The circuit arrangement of claim 1, wherein the DC voltage converter provides an auxiliary discharging voltage from the input voltage, and the auxiliary charging and discharging voltages are used for a plurality of independent bridge circuits that are coupled to the input voltage.

15. A circuit arrangement for supplying AC voltage to a plasma display panel, the arrangement comprising:

a transistor bridge having a pair of voltage input nodes and a pair of voltage output nodes, an input voltage coupled to the pair of voltage input nodes of the transistor bridge, a capacitor of a plasma cell coupled to the pair of voltage output nodes of the transistor bridge, a DC voltage converter that provides an auxiliary discharging voltage from the input voltage, and a discharging circuit that receives the auxiliary discharging voltage and provides discharging current to the capacitor.

16. The circuit arrangement of claim 15, wherein the DC voltage converter is a buck converter.

17. The circuit arrangement of claim 16, wherein the buck converter comprises a supply transistor, a supply diode and a supply inductor.

18. The circuit arrangement of claim 17, wherein the supply transistor shares a first common connection point with a positive side of the input voltage and shares a common connection point with the supply inductor and an anode of the supply diode.

19. The circuit arrangement of claim 17, wherein the supply inductor is connected to a discharging transistor of the discharging circuit.

20. The circuit arrangement of claim 19, wherein the supply inductor is connected at least to a charging transistor of a charging circuit.

21. The circuit arrangement of claim 16, wherein the buck converter is connected to a positive side of the input voltage, a negative side of the input voltage, and toan auxiliary discharge capacitor that stores the discharge voltage.

22. The circuit arrangement of claim 15, wherein the auxiliary discharging voltage is less than half the input voltage.

23. The circuit arrangement of claim 15, wherein the discharging circuit includes a series combination of a discharging transistor, a discharging diode and a discharging inductor.

24. The circuit arrangement of claim 15, wherein the auxiliary discharging voltage is applied to an auxiliary discharging capacitor.

25. The circuit arrangement of claim 24, wherein a capacitance of the auxiliary discharging capacitor is significantly greater than a capacitance of the plasma cell.

26. The circuit arrangement of claim 25, whereinthe auxiliary discharging voltage is less than half the input voltage.

27. The circuit arrangement of claim 15, wherein the auxiliary discharging voltage is generated from a discharge of the capacitor of the plasma cell and stabilized by the DC voltage converter.

28. The circuit arrangement of claim 27, wherein the DC voltage converter compensates for losses caused by commutation and takes power from the input voltage.

29. A plasma display panel comprising a circuit arrangement for supplying AC voltage to the plasma display panel, the circuit arrangement including:

a transistor bridge having a pair of voltage input nodes and a pair of voltage output nodes, an input voltage coupled to the pair of voltage input nodes of the transistor bridge, a capacitor of a plasma cell coupled to the pair of voltage output nodes of the transistor bridge, a DC voltage converter that provides an auxiliary charging voltage from the input voltage, and a charging circuit that receives the auxiliary charging voltage and provides charging current to the capacitor.

* * * * *